US005823655A

United States Patent [19]

Brooks

[11] Patent Number: 5,823,655

[45] Date of Patent: Oct. 20, 1998

[54] INCONSPICUOUS MODULAR DECORATIVE LIGHTING APPARATUS

[76] Inventor: I. Morris Brooks, 3557 Marigold Way, St. George, Utah 84770

[21] Appl. No.: 585,859

[22] Filed: Jan. 16, 1996

[51] Int. Cl.[6] ..... F21S 1/14

[52] U.S. Cl. ..... 362/145; 362/249; 362/387; 362/806

[58] Field of Search ..... 362/145, 151, 362/152, 219, 249, 252, 387, 391, 806

[56] References Cited

U.S. PATENT DOCUMENTS

| | | | |
|---|---|---|---|
| 3,404,268 | 10/1968 | Fowler | 362/418 |
| 3,500,036 | 3/1970 | Szentveri | 362/152 |
| 3,569,691 | 3/1971 | Tracy . | |
| 3,692,993 | 9/1972 | Robinson . | |
| 4,774,646 | 9/1988 | L'Heureux . | |
| 4,901,212 | 2/1990 | Prickett . | |
| 4,974,128 | 11/1990 | Prickett . | |
| 5,067,061 | 11/1991 | Prickett . | |
| 5,238,425 | 8/1993 | Kliewer . | |
| 5,311,414 | 5/1994 | Branham, Sr. . | |
| 5,404,279 | 4/1995 | Wood . | |

*Primary Examiner*—Y My Quach
*Attorney, Agent, or Firm*—Trask, Britt & Rossa

[57] ABSTRACT

A decorative lighting trim system is disclosed which comprises an assemblage of architectural moldings having a viewable surface which is structured to simulate an architectural trim or molding. The architectural molding is configured to retain lights, and to retain and conceal interconnecting electrical wiring to electrify the lights, in a manner which permits the attachment of the architectural moldings to a building surface. Because the architectural moldings are constructed to appear like conventional trims or moldings, the lighting system is virtually inconspicuous when attached to a house, building or other architectural structure, such as a fence or garage. The architectural moldings are in modular sections having varying selected lengths which allow the user to select the appropriate number and length of modular sections to extend along a given building surface, such as an eave, gable or window. The modular architectural molding assemblage is designed to be affixed relatively permanently to a building to eliminate the need for yearly seasonal hanging of lighting trim.

15 Claims, 3 Drawing Sheets

INCONSPICUOUS MODULAR DECORATIVE LIGHTING APPARATUS

BACKGROUND OF THE INVENTION

1. Field of the Invention

This invention relates to the decorative lighting of building exteriors of the type traditionally used during holiday seasons. Specifically, this invention relates to decorative lighting that is both inconspicuous and modular in construction.

2. State of the Art

It is a tradition for many individuals to decorate their homes with lights for special occasions such as Christmas. A great deal of time and trouble is involved in untangling strands of lights and fastening them to the house. Hanging the lights typically involves climbing up and down ladders and working on roofs. This situation is aggravated by the fact that most traditional decorating occurs in winter when weather conditions are cold and wet. In addition to being inconvenient and troublesome, decorating buildings with lights can also be dangerous. Many businesses also participate in traditional holiday decorating. Businesses may also use decorative lighting continuously in order to create different atmospheres.

One method used to alleviate problems involved in decorative lighting has been to leave nails or hooks in the building structure year-round. Strings of lights can then be hung from the fasteners used in previous years. However, nails or hooks left in the exterior of a building are unsightly and can compromise the integrity of the structure. Additionally, it is still necessary to string the lights year after year, in poor weather and at great heights. Many individuals have dealt with the problem by simply leaving the exposed strands of lights up all year. But many people feel that creates a tacky appearance which is unacceptable.

Examples of solutions to decorative lighting problems have been disclosed in U.S. Pat. No. 3,204,090 to Kvarda; U.S. Pat. No. 3,569,691 to Tracey; U.S. Pat. No. 3,692,993 to Robinson; U.S. Pat. No. 4,774,646 to L'Heureux; U.S. Pat. Nos. 4,901,212; 4,974,128 and 5,067,061 to Prickett; U.S. Pat. No. 5,238,425 to Kliewer; U.S. Pat. No. 5,311,414 to Branham and U.S. Pat. No. 5,404,279 to Wood.

The present invention is distinguishable from the prior art in that the present invention achieves an inconspicuous and attractive appearance for decorative lighting by taking the form of an architectural trim which blends naturally with the construction of the building. The present invention is also easy to install and adaptable to any size and shape of building by virtue of its modularity. In addition, the present invention has no moving parts as in U.S. Pat. No. 3,569,691; U.S. Pat. No. 3,692,993; U.S. Pat. No. 5,311,414 and U.S. Pat. No. 5,404,279.

There is a need for decorative lighting that is permanent, simple to manufacture, easy to install, easy to operate and is not only attractive, but relatively inconspicuous.

SUMMARY

In accordance with the present invention, apparatus for achieving decorative lighting provide modular, architectural moldings in various predetermined lengths which may be interconnected to form a length of architectural trim lighting suitable for attachment to a given part of a building structure. The present invention includes modular portions of architectural trim which are configured to retain lights and interconnecting electrical wiring. Each modular portion of architectural trim is configured to make at least one electrical connection with an adjacent modular portion of architectural trim, and multiple portions may be attached or aligned in a manner to provide a lighted trim along a given length of a building. The architectural moldings of the present invention may be sized and configured for use on any house, building or architectural structure, such as a fence, trellis or garage, and may be placed both indoors and outdoors. The present invention is described herein as an architectural lighting trim for the exterior of a house as an exemplar application.

The modular portions of architectural trim of the present invention may be substantially straight or linear forms which are positionable along a length of a building which is linear, such as an eave or a window casing. Angled modular portions of architectural trim are also provided so that the moldings may continue in an uninterrupted fashion around corners or around other areas such as windows. Thus, by selecting a number of linear modular portions sized to extend along a portion of a building and interconnecting the linear modular portions with angled modular portions, an entire house or building may be decorated, regardless of its size or dimensions, with modules that are easy to connect and install.

The modular portions of architectural molding are configured to retain one or more lights or interconnecting electrical wiring, or both. That is, a given length of linear modular architectural molding may retain a plurality of light bulbs and the necessary wiring interconnecting the plurality of light bulbs to electrify all of the light bulbs. Further, the angled modular portions, being sized and configured to extend, for example, around the corners of the eaves of a house, may retain only interconnecting wiring to complete an electrical circuit between modular portions positioned at either end of the angled modular portion. Alternatively, angled modular portions may retain light bulbs and suitable electrical wiring.

The modular portions, whether linear or angled, are configured to retain interconnecting electrical means to provide a continuing electrical circuit along adjacently positioned modular portions. In a particularly suitable embodiment, each modular portion may include a female connector means sized to receive a male electrical plug and a male connector means comprising an electrical plug. In an alternative embodiment, each modular portion may be configured to retain the electrical cord of a commercial string of lights which the purchaser attaches to the modular portion himself. Thus, the modular portions may be configured with lights and electrical wiring integrally formed with the modular portion, or the modular portions may be structured for retaining a separate and commercially available string of lights.

The architectural moldings of the present invention are constructed to give the appearance of a decorative trim on a building, such as a crown molding, so that the present invention is virtually inconspicuous when attached to the building. The modular portions may be made of wood, plastic, aluminum, or any other suitable material. The modular portions may be made in several architectural trim designs and may be provided in standard building colors (e.g., white) or may be painted later to match the color of the building and its trim.

The architectural moldings of the present invention may be left up permanently since they are inconspicuous and are designed to appear as conventional architectural trim. This provides the added benefit of one-time installation.

BRIEF DESCRIPTION OF THE DRAWINGS

In the drawings, which depict what is currently considered to be the best mode for carrying out the invention, in which like reference numerals refer to like parts in different views.

DETAILED DESCRIPTION OF THE ILLUSTRATED EMBODIMENT

Figure 1:
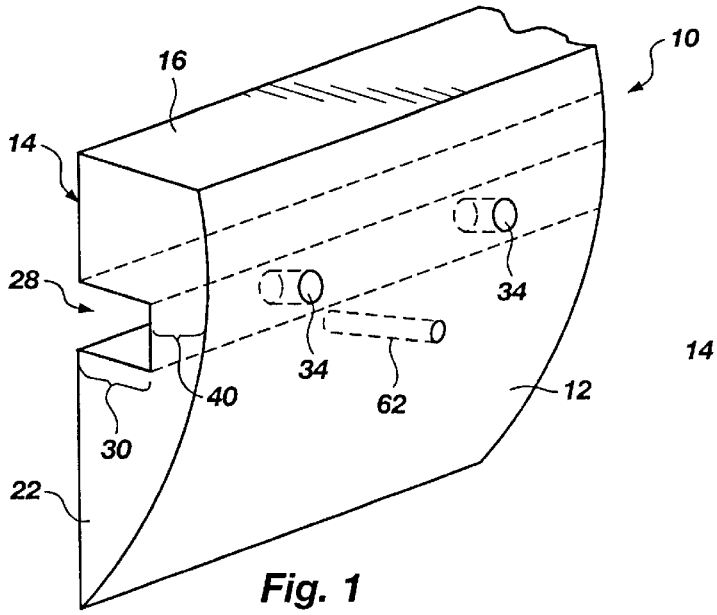
FIG. 1 is a view in perspective of a first embodiment of the architectural molding of the present invention, with some portions shown in phantom.

The architectural molding 10 of the present invention, as shown in FIG. 1, is a three-dimensional form having a front viewable surface 12 shaped to resemble an architectural trim design of the type typically used under eaves or around windows of a building. The molding design of the front viewable surface 12 may be shaped or designed to be readily incorporated into any other architectural structure, such as a door, fence, garage, garden trellis, or the like. The architectural molding 10 also has an opposing surface 14 spaced apart from the front viewable surface 12. The opposing surface 14 may also be termed a "contact surface" since it is the opposing surface 14 which may typically be positioned against a building surface. A top surface 16 may also be provided and may be positionable against a portion of a building to secure the architectural molding 10 thereto.

Figure 2:
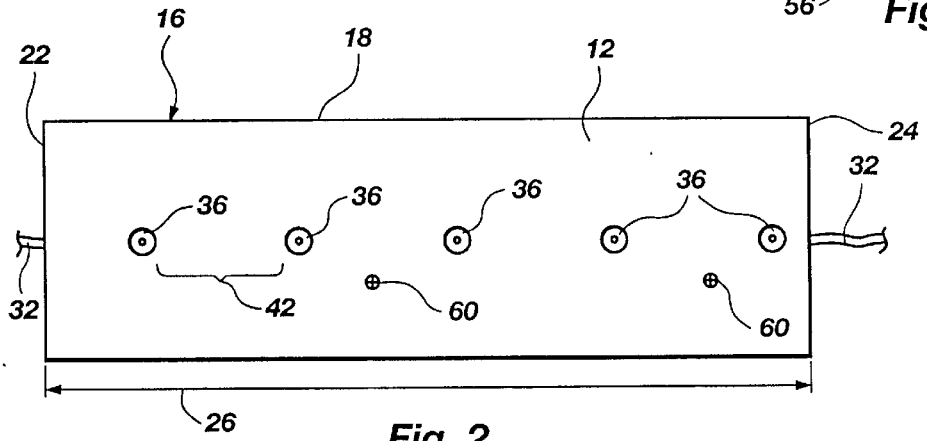
FIG. 2 is a front elevational view of a modular portion of the architectural molding.
Figure 3:
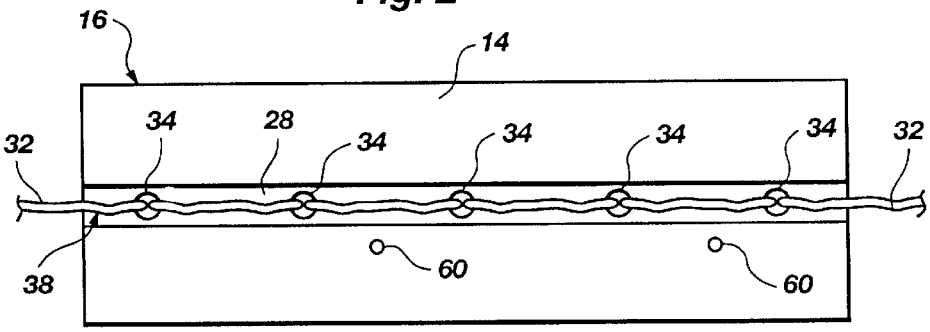
FIG. 3 is a rear elevational view of the modular portion shown in FIG. 2.

As shown more clearly in FIGS. 2 and 3, the architectural molding 10 of the invention is formed into modular portions 18, each having a first end 22 and a second end 24 spaced apart from the first end 22, and having a selected length 26 as measured from the first end 22 to the second end 24. A channel 28 (FIG. 3) may be formed in the opposing surface 14 of the architectural molding 10 along its length 26. The channel 28 is sized in depth 30 (FIG. 1) to retain and conceal electrical wires 32 (FIG. 2) therein such that the opposing surface 14 of the architectural molding 10 may be attached flush to a building surface.

The architectural molding 10 also contains holes 34 spaced along its length 26 which are sized in diameter to receive the lamp or light bulb portion 36 of a string 38 of decorative lights. The holes 34 are formed in the front viewable surface 12 of the architectural molding 10 and extend a distance 40 through the architectural molding 10 to emerge into the channel 28. The diameter of the holes 34 may be selected to accommodate any size bulb, from a miniature bulb to a large bulb of the type used in outdoor Christmas lighting. The holes 34 may be suitably spaced apart a distance 42 sufficient to accommodate adjacent lights on a standard string of lights. However, the distance 42 between the holes 34 may be smaller than the distance between lights on a standard string of lights, and the additional electrical wiring can be retained within the channel 28. Alternatively, the distance 42 between the holes 34 may be greater, particularly in an embodiment where the lights are integrally formed in the architectural molding 10.

Figure 4:
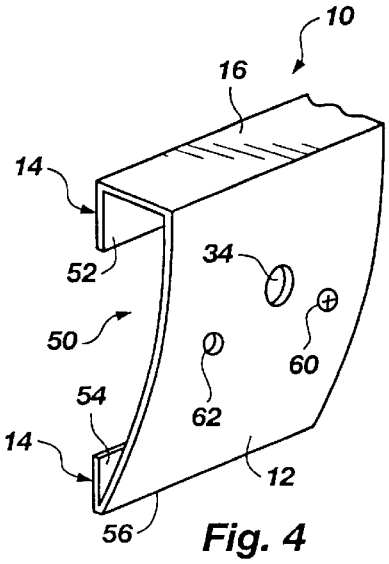
FIG. 4 is a view in perspective of an alternative embodiment of the architectural molding of the present invention.

One embodiment of the architectural molding 10 of the present invention is shown in FIGS. 1–3 where the three-dimensional form is solid. An alternative embodiment of the architectural molding 10 is shown in FIG. 4 where the front viewable surface 12 is spaced apart from an opposing surface 14 or contact surface, and an interior hollow space 50 is formed therebetween. As shown in FIG. 4, the opposing surface 14 may comprise a top flange 52 which extends from the top surface 16 of architectural molding 10 and a bottom flange 54 which extends from the bottom 56 of the front viewable surface 12. The top flange 52 and bottom flange 54 are positioned to contact the surface of a building to secure the architectural molding 10 thereagainst. The architectural molding 10 of the embodiment shown in FIG. 4 is configured with holes 34 which are sized to receive the lamp or bulb portion 36 (not shown in FIG. 4) of a string of lights therethrough. The electrical wires 32 (not shown in FIG. 4) are retained and concealed in the interior hollow space 50 formed behind the front viewable surface 12.

In both embodiments of the architectural molding 10, shown in FIGS. 1 and 4, the architectural molding 10 is configured to be secured to the surface of a building by securement means 60. Fastener holes 62 may be provided through the architectural molding 10 to permit the architectural molding 10 to be secured to the surface of a building by securement means 60, such as a nail or screw. The fastener holes 62 may pass through the front viewable surface 12 and the opposing surface 14, as shown in FIG. 1. Alternatively, the fastener holes 62 may pass through the front viewable surface 12 and into the interior hollow space 50, as shown in FIG. 4, to permit the passage of a securement means 60, such as a nail or screw, to engage the surface of the building. Other types of securement means may include, but are not limited to, nails, staples, rivets, snaps, glue, hook and loop fastening tape, or other suitable devices. The type of securement means may be selected to be permanent or semipermanent.

The architectural moldings 10 of the present invention may be formed as linear modular portions 18, as illustrated in FIGS. 2 and 3, for positioning along surfaces of a building which are straight or linear, such as along the eaves or fascia of a house, around window casings, along door casings, along fences, or the like. However, the architectural moldings 10 of the present invention are also formed as angled modular portions 70, as shown in FIGS. 5–7, to provide a continuous decorative molding around corners.

Figure 5:
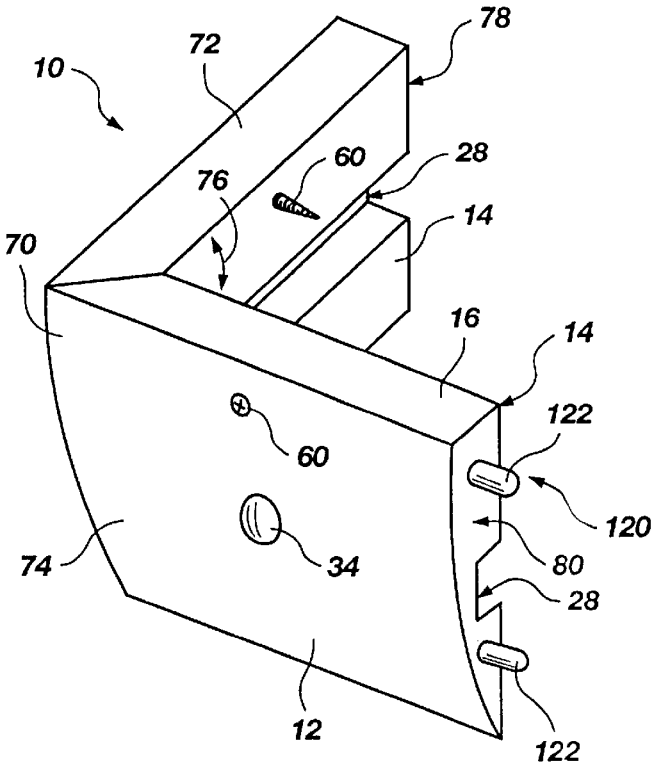
FIG. 5 is a view in perspective of a first angled modular portion of the architectural molding.

For example, FIG. 5 illustrates an angled modular portion 70 which is configured to extend around a substantially 90° linear corner. That is, the angled modular portion 70, shown in FIG. 5, comprises a first section 72 and a second section 74 which are formed at an angle 76 to each other so that the opposing surface 14 of the first section 72 and the opposing surface 14 of the second section 74 are positioned at substantially a 90° angle 76 to each other. By "substantially 90°" is meant that the angle 76 may vary from a strictly right angle and may range from about eighty degrees to about 110 degrees. The angled modular portion 70 shown in FIG. 5 has a first end 78 and a second end 80 which are sized to receive a linear modular portion 18 (FIG. 2) thereagainst to form a continuous architectural lighting trim system. The angled modular portion 70 has a channel 28 formed therein for retaining and concealing electrical wires (not shown) therein, and may include holes 34 for positioning a lamp or light bulb 36 (not shown in FIG. 5) therethrough. However, the angled modular portion 70 may be devoid of holes 34 for displaying lights and, in such an embodiment, may serve only to conceal electrical wires, to provide electrical continuity and to provide a continuous and inconspicuous system of architectural lighting trim.

Figure 6:
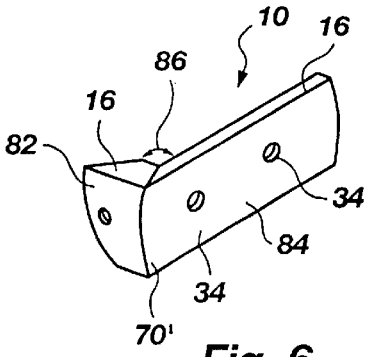
FIG. 6 is a view in perspective of a second angled modular portion of the architectural molding.

In an alternative embodiment shown in FIG. 6, the illustrated angled modular portion 70' comprises a first section 82 and a second section 84 which is positioned at substantially a right angle to the first section 82 (i.e., the opposing surface [not shown] of the first section is positioned at substantially a right angle to the opposing surface [not shown] of the second section), but is canted upwardly at a selected angle 86. That is, the top surface 16 of the second section 84 is positioned at an angle 86 to the top surface 16 of the first section 82. The angled modular portion 70' illustrated in FIG. 6 is configured to extend around the corner of a building and to be directed upwardly at an angle to enable architectural moldings 10 to be placed along the fascia of a gable of a house or building. The angle 86 of the second section 84 relative to the first section 82 is selected to accommodate the angle at which the gabled roof extends upwardly from the linear eave of the house or building. Thus, the angle 86 may be from about twenty degrees, for a low-pitched roof, to about seventy degrees, for a steeply-pitched roof.

Figure 7:
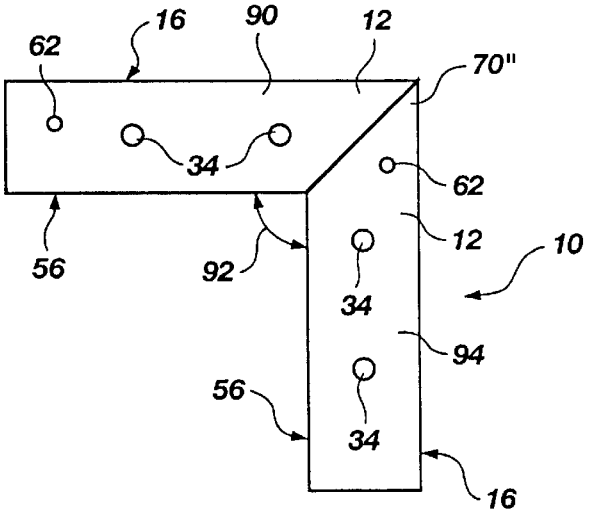
FIG. 7 is a plan view of a third angled modular portion of the architectural molding.

Another alternative embodiment for an angled modular portion 70" is illustrated in FIG. 7 where the bottom 56 of a first section 90 is positioned at a selected angle 92 to the bottom 56 of a second section 94. The selected angle 92 between the first section 90 and second section 94 may be acute or obtuse, depending upon the architectural requirements of the building where the angled modular portion 70" is to be placed. The angled modular portion 70" illustrated in FIG. 7 is configured to be used with linear modular portions 18 to, for example, encircle a window casing to provide an architectural lighted trim about a window. The angled modular portion 70" may also be used to provide a continuous and inconspicuous architectural molding at the point of a gable of the building.

The angled modular portions 70, 70' and 70" illustrated in FIGS. 5–7 may suitably be configured with a channel 28 or similar means for retaining the electrical wiring which interconnects lights on a string of commercial lights. As shown in FIGS. 5–7, the angled modular portions 70, 70' and 70" may also contain holes 34 for receiving lamps or light bulbs 36 (not shown) therethrough. Alternatively, the angled modular portions 70, 70' and 70" may be devoid of holes 34. The angled modular portions 70, 70' and 70" may be of solid, three-dimensional construction as illustrated in FIG. 1. Alternatively, the angled modular portions 70, 70' and 70" may be formed with a hollow interior space 50, as illustrated in FIG. 4. Preferably, the angled modular portions 70, 70' and 70" include securement means 60 for attachment to the building, and may include fastener holes 62 where appropriate for placement of nails or screws therethrough.

The architectural moldings 10 of the present invention are configured as modular portions 18 and angled modular portions 70, 70' and 70" to allow a user to easily and quickly install a modular architectural lighting trim. The ease of installment is facilitated primarily by providing varying lengths of linear modular portions 18. Thus, for example, if a user wishes to install a modular lighting system on his home along the eaves and fascia of the home, he only needs to select the correct number and size of angled modular portions 70, 70' or 70" appropriate to fit on the fascia at the corners or gables of the house, and then measure the remaining distance between any two angled modular portions 70, 70' or 70". The remaining distance measured between angled modular portions 70, 70' or 70" positioned at the corners can be divided in a manner to assure the placement of the correct number and lengths of linear modular portions 18 to form a continuous assemblage of modular architectural lighting trim.

For example, the user, having a home with a flat roof, obtains two angled modular portions 70 of the type illustrated in FIG. 5. He measures the linear distance along the fascia from one end of the house to the other; say, forty feet. He subtracts from that measurement of forty feet the length of the first section 72 of the first angled modular portion 70 (say, one foot) and the length of the second section 74 of the second angled modular portion 70 (say, one foot). The distance remaining between the two angled modular portions 70 after placement of those angled modular portions 70 at the corner of the house is thirty-eight feet. The user then selects a number of linear modular portions 18 which equals thirty-eight feet (say, three sections of ten feet each and two sections of four feet each).

The user then installs the architectural moldings 10 as follows: he secures the first angled modular portion 70 to the first corner of the house and secures the second angled modular portion 70 to the second corner of the house. He then positions a first linear modular portion 18 adjacent to the first angled modular portion 70, connects the electrical wiring (as described more fully hereinafter) to complete the circuit, and secures the first modular portion 18 to the house. He then positions the next linear modular portion 18 adjacent (end-to-end) the first linear modular portion 18, connects the electrical wiring to complete the circuit and secures the second linear modular portion 18 to the house. The user continues accordingly with each linear modular portion until he reaches the other modular. He then positions the second angled corner portion 70 adjacent the last linear modular portion 18, connects the electrical wiring to complete the circuit and secures the second angled modular portion 70 to the corner of the house. The remaining male end of the electrical wiring may be positioned to extend to a socket, or may be connected to an extension cord if appropriate. It is obvious that the order of attachment of architectural moldings to a surface may vary from the previous description.

The architectural moldings 10 of the present invention may be configured, in one embodiment, to receive a commercially-available string of conventional lights, such as those which are available during the Thanksgiving/Christmas holiday season. Thus, the user may purchase the color and style of lights he prefers to use in the decoration of his home or building, and selects the length and number of architectural moldings 10 suitable to extend along those portions of the home or building which are to be decorated with lights. The user may then install the string or strings of commercially-available lights through the holes 34 and channels 28 (or interior hollow spaces 50) formed in the modular portions 18 or angled modular portions 70.

Figure 8:
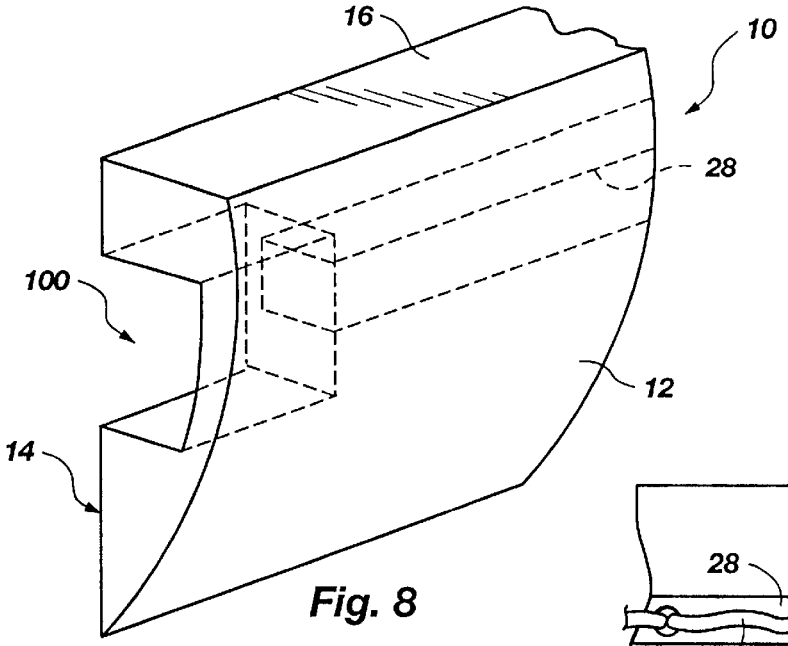
FIG. 8 is a view in perspective of an alternative embodiment of the architectural molding shown in FIG. 1, with some portions shown in phantom.
Figure 9:
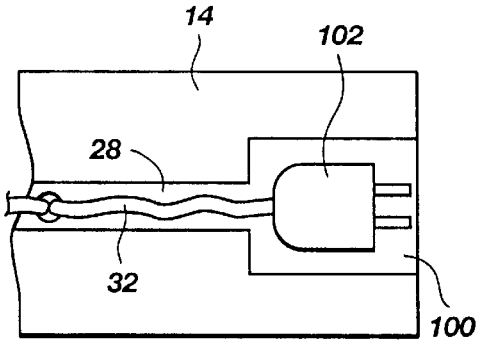
FIG. 9 is a rear elevational view of the portion of architectural molding shown in FIG. 8.

If the user installs the light string or strings in the architectural moldings 10 as previously described, the architectural moldings 10 may, most suitably, be configured as shown in FIGS. 8 and 9. That is, selected modular portions 18, as shown, or selected angled modular portions 70 (not shown), may be configured with an enlarged space 100 formed in the opposing side 14 of the architectural molding 10 and in general alignment with the channel 28. The enlarged space 100 may be sized to receive the male or female electrical connector 102 from a string of lights, and to retain the electrical connector 102 so that the architectural molding 10 may be positioned flush against the surface of a building. Enlarged spaces 100 may be formed at opposing ends of adjacently positionable architectural moldings 10 so that the male electrical connector of the last string of lights can be interconnected to the female electrical connector of the next string of lights positioned in the adjacent modular portion 18 or angled modular portion 70.

Figure 10:
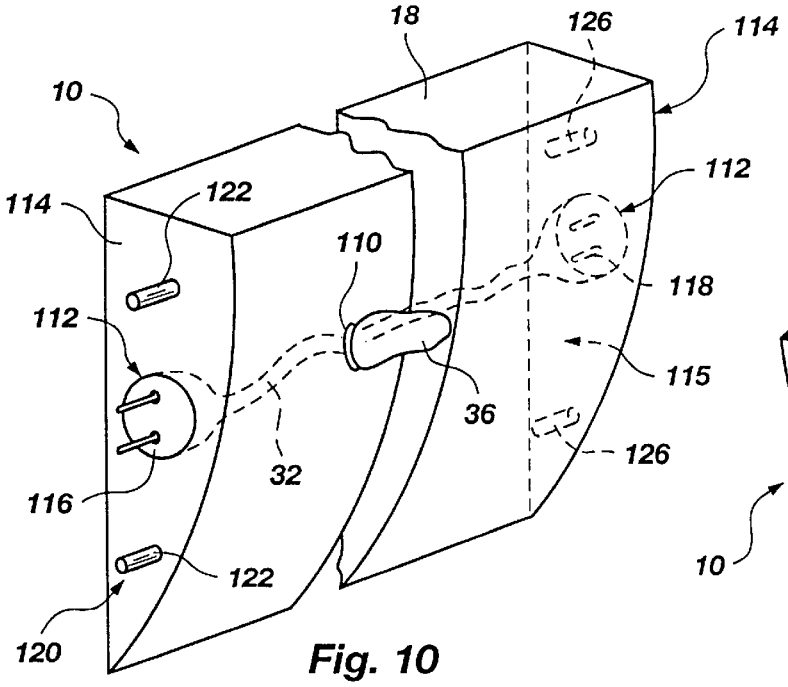
FIG. 10 is a view in perspective of a foreshortened alternative embodiment of the modular portion of architectural molding.
Figure 11:
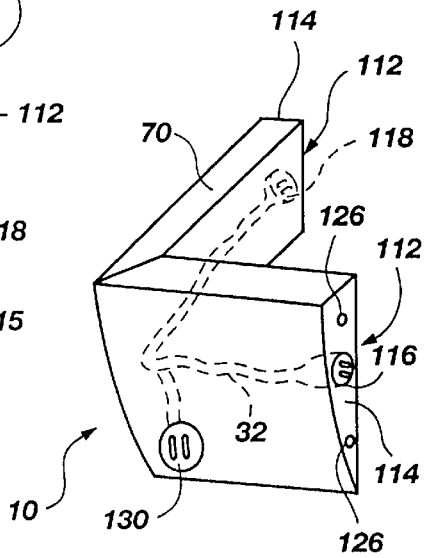
FIG. 11 is a view in perspective of an alternative embodiment of an angled modular portion of the architectural molding.

In an alternative embodiment, as shown in FIGS. 10 and 11, the architectural moldings 10 may be manufactured in a manner which, for example, imbeds the electrical wiring 32 (shown in phantom) within the modular portion 18 (or angled modular portion 70) so that the electrical wiring 32 is integrally formed in the architectural moldings 10 and no channel 28 is required. The architectural moldings 10 may also be formed with sockets 110 spaced along the length of the architectural molding 10 which permit the insertion and removal of lamps or light bulbs 36 when a bulb burns out, or when the owner wishes to change the color of the bulbs. In this embodiment, each modular portion 18, as illustrated in FIG. 10, or each angled modular portion 70, as illustrated in FIG. 11, is configured with electrical connector means 112 at each end 114 so that multiple architectural moldings 10 may be interconnected in adjacent positioning to one another. One end 114 may bear a male electrical connector means 116 while the opposing end 115 may bear a female electrical connector means 118.

The architectural moldings 10 of the present invention are sized and dimensioned to be aligned along the surface of a building to achieve a continuous decorative lighting trim. To achieve a look of continuous decorative lighting trim, the architectural moldings 10 are positioned adjacently end-to-end. The ends of adjacent architectural moldings 10 may simply be brought into close abutment with one another and secured in place by securement means to produce a continuous length of architectural moldings 10. Alternatively, however, the architectural moldings may be structured with attachment means which align and attach each architectural molding 10 to the next adjacent architectural molding 10. The form of the attachment means may vary considerably. One exemplar form of attachment means 120 is shown in FIGS. 5, 10 and 11 where alignment pegs 122 are formed at one end 114 of a modular portion 18 or angled modular portion 70, and alignment holes 126 are formed in the opposing end 115, sized appropriately to receive alignment pegs 122 from an architectural molding 10 positioned adjacent thereto. Other suitable means may be used for attaching adjacent architectural moldings 10 to each other, such as interlocking snap means or appropriately configured ends which mate and clasp to each other. In addition to electrical connector means 112 positioned at the ends 114 of the architectural moldings 10, certain modular portions 18 or angled modular portions 70 may be structured with an additional outlet 130 into which other strands of lights may be plugged for electrification. Providing an additional electrical outlet 130 enables strands of lights which are wound about nearby bushes or trees to be plugged into the architectural moldings 10 for convenience. The necessity for additional extension cords and an unsightly abundance of electrical cords is eliminated.

Figure 12:
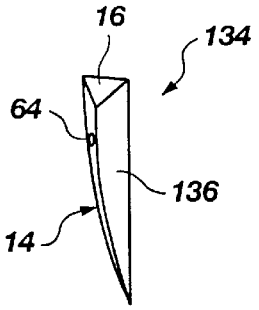
FIG. 12 is a view in perspective of an end portion of the architectural molding of the present invention.

In addition to the previously described modular portions 18 and angled modular portions 70, 70' and 70", the architectural moldings may include end portions 134, as illustrated in FIG. 12, which are securable against the last architectural molding 10 in a continuous architectural trim lighting assemblage. The end portions 134 have a front viewable surface 14 which is configured with an architectural trim design similar to the architectural moldings 10 being installed, a top surface 16 and a mating end surface 136 which is positionable against the end 22, 24 of an architectural molding 10 to provide a finished look to the architectural trim lighting assemblage. The end portions 134 may also include securement means 64 for attaching the end portions 134 to the surface of a building.

The architectural moldings 10 of the present invention may be formed from any suitable material which is durable and able to withstand weather extremes since the architectural moldings 10 are intended to be left on the house year round. It may also be particularly suitable to form the architectural moldings 10 from a material that is easily painted or coated so that the color of the architectural trim may be changed throughout the years as desired by the homeowner. Particularly suitable materials include wood, plastic, aluminum, high impact and durable polymers and rubbers, and the like.

The architectural moldings of the present invention provide a decorative and relatively inconspicuous means for attaching decorative lighting to the indoors, and especially the outdoors, of a building, home or architectural structure. The architectural moldings may be made in any number of architectural designs of the type used in moldings for outdoors and indoors. The architectural moldings are lightweight, durable, easy to assemble and install, and may be left on the building permanently or for an extended period of time. The present invention eliminates the hassle of decorating homes and buildings year after year for the holidays or other special occasions. The structure of the invention may be modified to meet the demands of the particular application. Hence, reference herein to specific details of the illustrated embodiments is by way of example and not by way of limitation. It will be apparent to those skilled in the art that many additions, deletions and modifications to the illustrated embodiments of the invention may be made without departing from the spirit and scope of the invention as defined by the following claims.

What is claimed is:

1. Apparatus for providing a modular, inconspicuous decorative lighting trim comprising:

a three-dimensional architectural molding sized and dimensioned for attachment to a building surface, said architectural molding having a viewable surface which is configured to simulate an architectural trim;

at least one aperture formed through said architectural molding for positioning a light bulb therethrough;

a contact surface contacting said building surface and spaced apart from said viewable surface for attaching said architectural molding to said building surface; and channel means formed in and along said contact surface for retaining and concealing electrical wires interconnected to said light bulb positioned in said at least one aperture.

2. The apparatus of claim 1 wherein said at least one aperture is formed through said viewable surface.

3. The apparatus of claim 1 wherein said channel means for retaining and concealing is an interior hollow space.

4. The apparatus of claim 1 further comprising securement means positioned along said architectural molding to secure said architectural molding to said building surface.

5. The apparatus of claim 1 wherein said architectural molding is a modular portion having a selected length, a first end for alignment with an adjacent architectural molding and a second end for alignment with an adjacent architectural molding.

6. The apparatus of claim 5 wherein said at least one aperture is a plurality of holes positioned through said viewable surface and spaced apart from each other along said selected length of said modular portion.

7. The apparatus of claim 6 wherein said modular portion includes a channel configured to retain and conceal at least one electrical connector connected to said electrical wires.

8. The apparatus of claim 7 wherein said channel is configured to retain and conceal said at least one electrical connector in proximity to at least one of said first end and said second end.

9. The apparatus of claim 6 wherein said channel means for retaining and concealing is an interior hollow space formed along said selected length of said modular portion.

10. The apparatus of claim 9 wherein said interior hollow space is sized to retain and conceal at least one electrical connector connected to said electrical wires.

11. The apparatus of claim 1 wherein said architectural molding further comprises a first end and a second end, said architectural molding being further structured with attachment means in proximity to said first end and said second end for attaching architectural moldings in adjacent and end-to-end alignment.

12. Apparatus for providing a modular, inconspicuous decorative lighting trim comprising:

a three-dimensional architectural molding sized and dimensioned for attachment to a building surface, said architectural molding comprising a first section and a second section secured to said first section at an angle to said first section, and each of said first section and said second section having a viewable surface which is configured to simulate an architectural trim, and a contact surface contacting a building surface; and channel means formed in and along said contact surface of said first section and said second section for retaining and concealing electrical wires within said three-dimensional architectural molding.

13. The apparatus of claim 12 further comprising aperture means formed through said viewable surface of said architectural molding for positioning at least one light bulb therethrough.

14. The apparatus of claim 12 wherein said first section has a first end and said second section has a second end, and wherein said architectural molding further comprises an electrical connector positioned at said first end and an electrical connector positioned at said second end.

15. A method for decorating a building with decorative trim lighting comprising:

providing a plurality of modular, three-dimensional architectural molding members sized and dimensioned for attachment to a building surface, each said architectural molding member comprising;

a viewable surface which is configured to simulate an architectural trim which renders the three-dimensional architectural molding members virtually inconspicuous when attached to a building surface;

a contact surface positioning against said building surface, said contact surface having a channel formed therein;

a first end;

a second end spaced apart from said first end;

electrical wiring retained and concealed within said channel of said modular, three-dimensional architectural molding member, said electrical wiring including a female electrical connector member positioned at one of said first end and said second end and a male electrical connector member positioned at the other of said first end and said second end; and at least one light bulb positioned through said viewable surface, said at least one light bulb being in electrical communication with said electrical wiring;

aligning the second end of a first said modular, architectural molding member with the first end of a second said modular, architectural molding; and attaching said electrical wiring of said first modular, architectural molding member to said electrical wiring of said second modular, architectural molding member in adjacent alignment with said first modular, architectural molding member by interconnection of a female electrical connector member to a male electrical connector member.

* * * * *